US009850783B2

(12) United States Patent
Hikichi et al.

(10) Patent No.: US 9,850,783 B2
(45) Date of Patent: Dec. 26, 2017

(54) LIQUID PUMP INCLUDING A GAS ACCUMULATION AREA AND RANKINE CYCLE DEVICE INCLUDING A LIQUID PUMP

(71) Applicant: Panasonic Intellectual Property Management Co., Ltd., Osaka (JP)

(72) Inventors: Takumi Hikichi, Osaka (JP); Osao Kido, Kyoto (JP); Atsuo Okaichi, Osaka (JP); Yoshio Tomigashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 240 days.

(21) Appl. No.: 14/661,731

(22) Filed: Mar. 18, 2015

(65) Prior Publication Data

US 2015/0275696 A1 Oct. 1, 2015

(30) Foreign Application Priority Data

Apr. 1, 2014 (JP) ..... 2014-075032

(51) Int. Cl.
*F04C 2/10* (2006.01)
*F04C 15/06* (2006.01)
(Continued)

(52) U.S. Cl.
CPC ..... *F01K 7/00* (2013.01); *F04C 2/10* (2013.01); *F04C 13/007* (2013.01);
(Continued)

(58) Field of Classification Search
CPC ..... F04B 11/00; F04B 11/008; F04D 29/66; F04D 29/669; F04D 29/708;
(Continued)

(56) References Cited

U.S. PATENT DOCUMENTS 2,763,214 A * 9/1956 White ..... F04D 13/0613 417/357
3,162,129 A 12/1964 Erikson
(Continued)

FOREIGN PATENT DOCUMENTS

CN 102369845 3/2012
DE 37 20 690 1/1988
(Continued)

OTHER PUBLICATIONS

Extended European Search Report dated Nov. 27, 2015 in corresponding European patent application No. 15 15 9766.
(Continued)

*Primary Examiner* — Laert Dounis
(74) *Attorney, Agent, or Firm* — Wenderoth, Lind & Ponack, L.L.P.

(57) ABSTRACT

A liquid pump includes: a casing; a feed pipe bringing liquid from outside the casing to inside the casing; a pump mechanism provided in the casing and including a suction hole for sucking in the liquid and a discharge hole for discharging the liquid sucked in via the suction hole; a suction space positioned in the casing on a suction-hole inlet side and making a flow path formed by the feed pipe and the suction hole communicate with each other; and a discharge space positioned on a discharge-hole outlet side in the casing and communicating with the discharge hole. The suction space includes a gas accumulation area that is positioned above a center of an opening at casing-side end of the feed pipe, when viewed vertically and that accumulates gas brought into the casing through the feed pipe together with the liquid to separate the gas from the liquid.

15 Claims, 9 Drawing Sheets

(51) Int. Cl.

| | |
|---|---|
| ***F04D 29/66*** | (2006.01) |
| ***F01K 7/00*** | (2006.01) |
| ***F04C 15/00*** | (2006.01) |
| ***F04C 13/00*** | (2006.01) |
| ***F04D 1/00*** | (2006.01) |
| ***F04D 13/06*** | (2006.01) |
| ***F04D 13/16*** | (2006.01) |
| ***F04D 9/00*** | (2006.01) |

(52) U.S. Cl.
CPC ..... *F04C 15/008* (2013.01); *F04C 15/06* (2013.01); *F04D 1/00* (2013.01); *F04D 9/003* (2013.01); *F04D 13/06* (2013.01); *F04D 13/16* (2013.01); *F04D 29/669* (2013.01)

(58) Field of Classification Search
CPC ..... F04C 2270/14–2270/145; F04C 29/0035; F04C 2240/30; F04C 2/10–2/106; F04C 18/10; F04C 18/103; F01C 1/10–1/105
USPC ..... 418/181, 191–206.9; 415/169.1–169.4, 415/540, 542
See application file for complete search history.

(56) References Cited

U.S. PATENT DOCUMENTS

| | | | | |
|---|---|---|---|---|
| 3,321,909 | A | 5/1967 | Gordon | |
| 3,685,927 | A | 8/1972 | Petersen et al. | |
| 4,249,864 | A | 2/1981 | Foley | |
| 4,427,351 | A * | 1/1984 | Sano | F04C 29/068 417/540 |
| 4,775,292 | A | 10/1988 | Jensen et al. | |
| 5,221,178 | A * | 6/1993 | Yoshioka | F02M 37/048 415/169.1 |
| 5,327,987 | A * | 7/1994 | Abdelmalek | B60K 6/48 180/65.25 |
| 5,961,309 | A * | 10/1999 | Harpole | F04C 15/0049 417/540 |
| 2005/0012387 | A1* | 1/2005 | Suzuki | F04C 2/102 303/116.4 |
| 2013/0280041 | A1* | 10/2013 | Kumamoto | F04D 1/00 415/116 |
| 2016/0123323 | A1* | 5/2016 | Naiki | F01C 21/108 418/9 |

FOREIGN PATENT DOCUMENTS

| | | |
|---|---|---|
| DE | 10121823 | 8/2002 |
| EP | 761969 | 3/1997 |
| EP | 1 482 175 | 12/2004 |
| FR | 2 320 437 | 3/1977 |
| FR | 2320437 | 3/1977 |
| GB | 2092226 | 8/1982 |
| JP | 06167278 A * | 6/1994 |
| JP | 2004-346820 | 12/2004 |
| JP | 2012-202374 | 10/2012 |
| WO | 1999/045272 | 9/1999 |

OTHER PUBLICATIONS

Extended European Search Report dated Sep. 9, 2015 in corresponding European patent application No. 15159766.3.
EPO Communication pursuant to Rule 114(2) EPC dated Feb. 26, 2016 in corresponding European Patent Application No. 15159766.3.
The Extended European Search Report dated Oct. 25, 2016 in corresponding European Patent Application No. 15159766.3.

* cited by examiner

LIQUID PUMP INCLUDING A GAS ACCUMULATION AREA AND RANKINE CYCLE DEVICE INCLUDING A LIQUID PUMP

BACKGROUND

1. Technical Field

The present disclosure relates to a liquid pump and a Rankine cycle device including the liquid pump.

2. Description of the Related Art

Lately, energy systems using natural energy, such as sunlight, or exhaust heat of various kinds are attracting attention. One example of such energy systems is a system employing the Rankine cycle. Generally, in a system employing the Rankine cycle, an expander is operated with high-temperature, high-pressure working fluid, and extracts power from the working fluid to generate electric power. The high-temperature, high-pressure working fluid is generated by a pump and a heat source (such as solar heat, geothermal heat, or exhaust heat from a car).

As illustrated in FIG. 9, Japanese Unexamined Patent Application Publication No. 2012-202374 describes an electric generating device 300. The electric generating device 300 includes a circulation flow path 306, which includes a pump 301, an evaporator 302, an expander 303, and a condenser 304. The expander 303 expands a working medium evaporated by the evaporator 302 and extracts kinetic energy from the working medium. An electric generator 305 is connected to the expander 303 and is driven by the expander 303. The working medium in a liquid state is condensed and pressurized to a predetermined pressure by the pump 301 and is discharged to the evaporator 302.

The circulation flow path 306 between the condenser 304 and the pump 301 is provided with a pressure sensor 311 and a temperature sensor 312. The pressure sensor 311 detects a pressure Ps of the working medium on the inlet side of the pump 301. The temperature sensor 312 detects a temperature Ts of the working medium on the inlet side of the pump 301. The saturation vapor pressure of the working medium at the inlet of the pump 301 is derived from the detected value of the temperature sensor 312. On the basis of the saturation vapor pressure thus derived and the pressure of the working medium detected by the pressure sensor 311, the difference (difference in pressure) between the pressures is obtained, and the output of the pump 301 is adjusted according to the difference in pressure. In this way, the occurrence of cavitation in the pump 301 can be prevented.

As illustrated in FIG. 10, Japanese Unexamined Patent Application Publication No. 2004-346820 describes a refrigerant pump 500. The refrigerant pump 500 includes a hermetic case 510, an electric motor 511, a pump mechanism 512, a drive shaft 513, a suction board 516, a suction pipe 521, and a discharge pipe 520. The electric motor 511 includes a stator 511*a* and a rotor 511*b*. The stator 511*a* is attached to the outside of the hermetic case 510, and the rotor 511*b* is disposed in the hermetic case 510. Near the inlet of the suction pipe 521 of the suction board 516, a cutout 519 is formed by cutting out part of the suction board 516. In this way, a refrigerant suction path is securely obtained.

SUMMARY

The pump 301 of the electric generating device 300 of Japanese Unexamined Patent Application Publication No. 2012-202374 is open to improvement in terms of reliability.

One non-limiting and exemplary embodiment provides a highly reliable liquid pump capable of preventing damage to components, even when gas is brought into a casing together with liquid.

In one general aspect, the techniques disclosed here feature a liquid pump comprising: a casing; a feed pipe that brings liquid from outside the casing to inside the casing; a pump mechanism that is provided inside the casing, and that includes a suction hole through which the liquid is sucked in and a discharge hole through which the liquid sucked in via the suction hole is discharged; a suction space that is extended from an opening of the feed pipe to an inlet of the suction hole in the casing, and that connects a flow path formed by the feed pipe to the suction hole; and a discharge space that is positioned on a side with an outlet of the discharge hole in the casing and that connects to the discharge hole, wherein the suction space includes a gas accumulation area that is positioned above a center of the opening of the feed pipe on a side with the casing, in a cross section view of the liquid pump, and that accumulates gas brought into the casing through the feed pipe together with the liquid to separate the gas from the liquid.

The liquid pump of the present disclosure is capable of preventing damage to components, even when gas is brought into the casing together with liquid, and is hence highly reliable.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
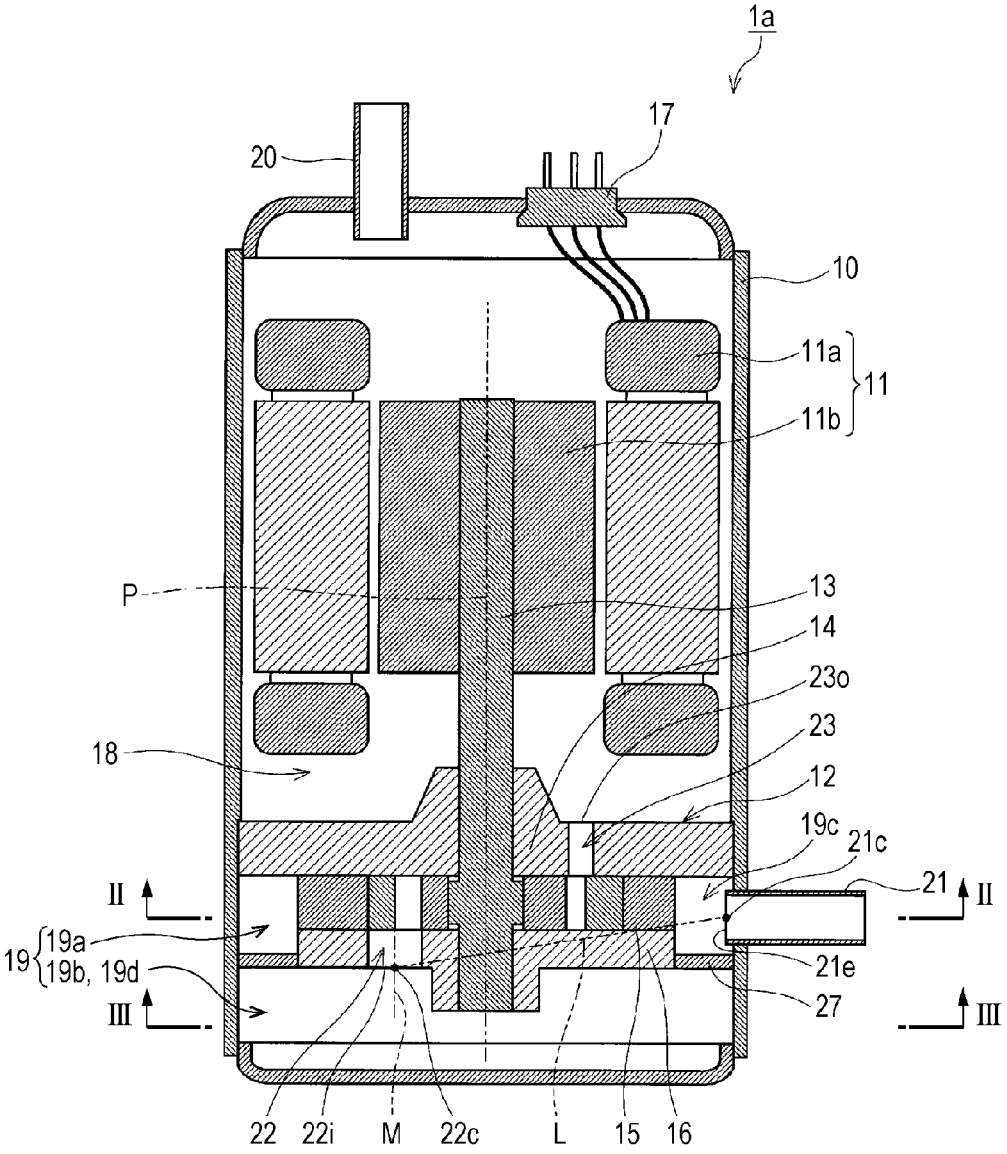
FIG. 1 is a longitudinal sectional view of a liquid pump according to an exemplary embodiment of the present disclosure.

In the above-described conventional technique, the liquid working medium condensed by the condenser 304 is sucked in by the pump 301 in the electric generating device 300. As a pump in a system employing the Rankine cycle as the electric generating device 300, a positive-displacement pump, such as a gear pump or a rotary pump, or a velocity pump, such as a centrifugal pump, is often used. When cavitation occurs in a working fluid flowing into the pump, principal parts in the pump are likely to be damaged.

Cavitation is a phenomenon in which, in a fluid machine, liquid working fluid flowing in the fluid machine comes to the boil when the pressure of a part of the liquid working fluid reaches the saturation vapor pressure, thereby forming small bubbles. The impact pressure attributable to breaking of the bubbles erodes the components of the fluid machine. For example, in the case where the fluid machine is of a velocity type fluid, principal parts such as the impeller are damaged.

Moreover, the working fluid condensed by the condenser may change from a liquid state to a gas-liquid two-phase state before being sucked into the pump, due to a decrease in pressure caused by a loss of pressure in the flow of the working fluid attributable to piping, or due to an increase in temperature caused by receiving heat. When such a change occurs, gas is brought into the pump together with the liquid, which may damage components of the pump as in the case where cavitation occurs in the fluid machine. In addition, since gas is mixed in the working fluid brought into the pump, the amount of working fluid discharged from the pump also changes. This change may lead to changes in the circulation amount of the working fluid and changes in pressure of the working fluid in the Rankine cycle. Consequently, the output of the electric power generation using the power collected by the expander may be inconsistent, or vibrations may occur in the piping.

In the electric generating device 300, the rotational speed of the pump 301 is regulated on the basis of the output values of the pressure sensor 311 and the temperature sensor 312. In this way, the working medium sucked in by the pump 301 is maintained in the liquid state, thereby preventing cavitation and suction of the working medium in the gas-liquid two-phase state. However, in the electric generating device 300, a delay may occur in the response time from when the rotational speed of the pump 301 is changed to when the state of the working medium at the inlet of the pump 301 is changed. In such a case, when cycle changes occur, for example, when the temperature of the heat source or the heat quantity of the heat source changes in the evaporator 302, or when the heat radiation temperature or the heat radiation amount changes in the condenser 304, the working medium in the gas-liquid two-phase state may flow into the pump 301. Moreover, the working medium in the gas-liquid two-phase state may flow into the pump 301 when the cycle is in transition, for example, when the electric generating device 300 is in operation. Further, the pressure sensor 311 and the temperature sensor 312 are required, which increases the complexity of the device configuration and consequently increases the device manufacturing cost.

With regard to the refrigerant pump 500, the refrigerant sucking path is secured by the cutout 519.

A first aspect of the present disclosure includes a liquid pump including: a casing; a feed pipe that brings liquid from outside the casing to inside the casing; a pump mechanism that is provided inside the casing, and that includes a suction hole through which the liquid is sucked in and a discharge hole through which the liquid sucked in via the suction hole is discharged; a suction space that is extended from an opening of the feed pipe to an inlet of the suction hole in the casing, and that connects a flow path formed by the feed pipe to the suction hole; and a discharge space that is positioned on a side with an outlet of the discharge hole in the casing and that connects to the discharge hole, wherein the suction space includes a gas accumulation area that is positioned above a center of the opening of the feed pipe on a side with the casing, in a cross section view of the liquid pump, and that accumulates gas brought into the casing through the feed pipe together with the liquid to separate the gas from the liquid.

According to the first aspect, even when gas is brought into the casing together with liquid, the gas is accumulated in the gas accumulation area in the suction space and is thereby separated from the liquid, which makes it easier for only the liquid to reach the inlet of the suction hole. With the above-described positional relationship between the end of the feed pipe on the side with the casing and the inlet of the suction hole, it is also difficult for the gas to reach the inlet of the suction hole. This prevents the gas accumulation area from affecting (i.e., isolating the gas accumulation area from) the flow of the liquid flowing from the feed pipe into the casing. Hence, even when gas is brought into the casing together with liquid, the gas is prevented from flowing into the pump mechanism, consequently preventing damage to the components of the pump mechanism. Moreover, since the liquid pump according to the first aspect includes the suction space and the discharge space, pulsation caused by suction of liquid or discharge of liquid in the pump mechanism can be prevented from being transmitted to the outside of the liquid pump.

A second aspect of the present disclosure provides the liquid pump according to the first aspect, in which the end of the feed pipe on the side with the casing is positioned at a height of the inlet of the suction hole or above the inlet of the suction hole, in the cross section view of the liquid pump. According to the second aspect, the above-described positional relationship between the end of the feed pipe on the casing side and the inlet of the suction hole makes it further difficult for gas to reach the inlet of the suction hole. Hence, even when gas is brought into the casing together with liquid, the gas is prevented from flowing into the pump mechanism, consequently preventing damage to the components of the pump mechanism.

A third aspect of the present disclosure provides the liquid pump according to the first aspect or the second aspect, in which an inner peripheral surface of the casing includes, as space-forming parts, only a part that forms the suction space and a part that forms the discharge space. According to the third aspect, the capacity of the suction space and the discharge space in the casing is large. Hence, pulsation caused by suction of liquid or discharge of liquid in the pump mechanism can be further prevented from being transmitted to the outside of the liquid pump. Moreover, since it is possible to increase the gas accumulation area, an even larger volume of gas can be accumulated.

A fourth aspect of the present disclosure provides the liquid pump according to any one of the first to third aspects, further including a shaft. In the liquid pump, the pump mechanism sucks in the liquid via the suction hole and discharges the liquid via the discharge hole by rotation of the shaft. According to the fourth aspect, by controlling the number of rotations of the shaft, the amount of flowing liquid can be adjusted. This makes it possible to minutely adjust the amount of flowing liquid. By adjusting the amount of flowing liquid according to the pressure or temperature of the liquid sucked in by the liquid pump, gas is prevented from being sucked in by the pump mechanism together with the liquid.

A fifth aspect of the present disclosure provides the liquid pump according to any one of the first to fourth aspects, further including a predetermined member that is provided on a line segment connecting the center of the opening at the end of the feed pipe on the side with the casing and a center of the inlet of the suction hole. According to the fifth aspect, since the suction space is formed to avoid the predetermined members, the liquid flowing into the casing through the feed pipe can be prevented from flowing into the suction hole of the pump mechanism via the shortest path connecting the feed pipe and the suction hole of the pump mechanism with a straight line. This can further prevent gas from being sucked into the pump mechanism together with liquid.

A sixth aspect of the present disclosure provides the liquid pump according to any one of the first to fifth aspects, further including a dividing member that divides the suction space into an upper space that is in contact with the end of the feed pipe on the side with the casing and a lower space that is in contact with the inlet of the suction hole. According to the sixth aspect, since liquid flowing into the casing through the feed pipe flows along the dividing member and then flows into the suction hole of the pump mechanism, it is possible to further prevent gas from being sucked in by the pump mechanism together with liquid.

A seventh aspect of the present disclosure provides the liquid pump according to any one of the first to sixth aspects, in which a straight line that extends along a central axis of the feed pipe to inside the casing and a straight line that passes a center of the inlet of the suction hole and is orthogonal to the inlet of the suction hole are included in different planes. According to the seventh aspect, since the length of the path along which the liquid brought into the casing through the feed pipe flows to reach the suction hole of the pump mechanism is increased, a period for separating gas from the liquid in the suction space can be increased. Hence, it is possible to further prevent gas from being sucked in by the pump together with liquid.

An eighth aspect of the present disclosure provides the liquid pump according to any one of the fourth to seventh aspects, in which, when a first line segment and a second line segment are projected on a plane orthogonal to the rotation axis of the shaft, an angle between the first line segment and the second line segment is in a range of 90° to 270°, the first line segment connecting the center of the opening at the end of the feed pipe on the side with the casing and a rotation axis of the shaft, the second line segment connecting a center of the inlet of the suction hole and the rotation axis of the shaft. According to the eighth aspect, since the length of the path along which the liquid brought into the casing through the feed pipe flows to reach the suction hole of the pump mechanism is increased, a period for separating gas from the liquid in the suction space can be increased. Hence, it is possible to further prevent gas from being sucked into the pump together with liquid.

A ninth aspect of the present disclosure provides the liquid pump according to any one of fourth to eighth aspects, further including an electric motor that is provided inside the casing and is connected to the pump mechanism via the shaft, and that drives the pump mechanism. According to the ninth aspect, since the electric motor is disposed in the casing, liquid can be prevented from leaking out from the casing.

A tenth aspect of the present disclosure provides the liquid pump according to any one of the ninth aspect, in which the electric motor is provided in the discharge space. According to the tenth aspect, since the heat generated in the electric motor can be collected by harnessing the liquid discharged from the pump mechanism, the efficiency of the liquid pump increases.

An eleventh aspect of the present disclosure provides the liquid pump according to any one of the first to tenth aspects, in which the suction space includes a reservoir area that holds the liquid. According to the eleventh aspect, liquid can be held in the suction space. Hence, the liquid pump can be used for a Rankine cycle device, for example.

A twelfth aspect of the present disclosure provides a Rankine cycle device including: a heater that heats working fluid; an expander that expands the working fluid heated by the heater; a radiator that dissipates heat of the working fluid expanded by the expander; and a liquid pump according to any one of the first to eleventh aspects. In the Rankine cycle device, the working fluid in a liquid state flowing out from the heater is brought, as the liquid, to inside the casing via the feed pipe.

To increase the efficiency of the Rankine cycle, it is desirable that the working fluid flowing out from the radiator be supercooled liquid having a smallest-possible degree of supercooling or be saturated liquid. However, the working fluid in such a state easily enters the gas-liquid two-phase state when the pressure of the working fluid is slightly reduced or when the working fluid is slightly heated. According to the twelfth aspect, even when liquid working fluid flowing out from the radiator changes to the gas-liquid two-phase state as a result of pressure reduction or heating, and consequently gaseous working fluid is brought into the liquid pump together with liquid working fluid, gas is prevented from flowing into the pump mechanism. This can prevent damage to the components of the pump mechanism. Hence, it is possible to prevent damage to the components of the pump mechanism while operating the Rankine cycle device with a highly efficient Rankine cycle.

A thirteenth aspect of the present disclosure provides the liquid pump according to any one of the fourth to eleventh aspects, in which the shaft extends vertically or horizontally, and the gas accumulation area is positioned above a vertical center of a working chamber of the pump mechanism when the shaft extends vertically or is positioned above a rotation axis of the shaft when the shaft extends horizontally.

According to the thirteenth aspect, since the gas accumulation area is provided further above, gas separated from liquid in the gas accumulation area is less likely to flow into the suction hole.

In the following, an embodiment of the present disclosure will be described with reference to the drawings. Note that the following description is of an example of the present disclosure, and the present disclosure should not be limited thereto.

Liquid Pump

As illustrated in FIG. 1, a liquid pump 1*a* includes a casing 10, a feed pipe 21, a pump mechanism 12, a suction space 19, and a discharge space 18. The feed pipe 21 is a pipe that brings liquid from the outside of the casing 10 to inside the casing 10. The pump mechanism 12 is disposed in the casing 10, and has a suction hole 22 and a discharge hole 23. The suction hole 22 is a hole through which liquid is sucked in. The discharge hole 23 is a hole through which the liquid sucked in via the suction hole 22 is discharged. The suction space 19 is positioned on the side with an inlet 22*i* of the suction hole 22 in the casing 10, and causes the flow path formed by the feed pipe 21 and the suction hole 22 to communicate with each other. The discharge space 18 is positioned on the side with an outlet 23*o* of the discharge hole 23 in the casing 10, and communicates with the discharge hole 23.

The liquid pump 1*a* further includes a motor 11, a shaft 13, a discharge pipe 20, and a dividing member 27. The liquid pump 1*a* is a hermetic pump, and the inner space of the casing 10 communicates with the outer space of the casing 10 via only the feed pipe 21 and the discharge pipe 20. The shaft 13 extends vertically. The pump mechanism 12 includes an upper bearing member 14, a pump case 15, and a lower bearing member 16. The pump case 15 is provided between the upper bearing member 14 and the lower bearing member 16.

In the pump mechanism 12, liquid is sucked in by the pump mechanism 12 via the suction hole 22 and is discharged from the pump mechanism 12 via the discharge hole 23 by rotation of the shaft 13. In this embodiment, liquid is sucked in from a lower part of the pump mechanism 12 and is discharged to an upper part of the pump mechanism 12.

Figure 2:
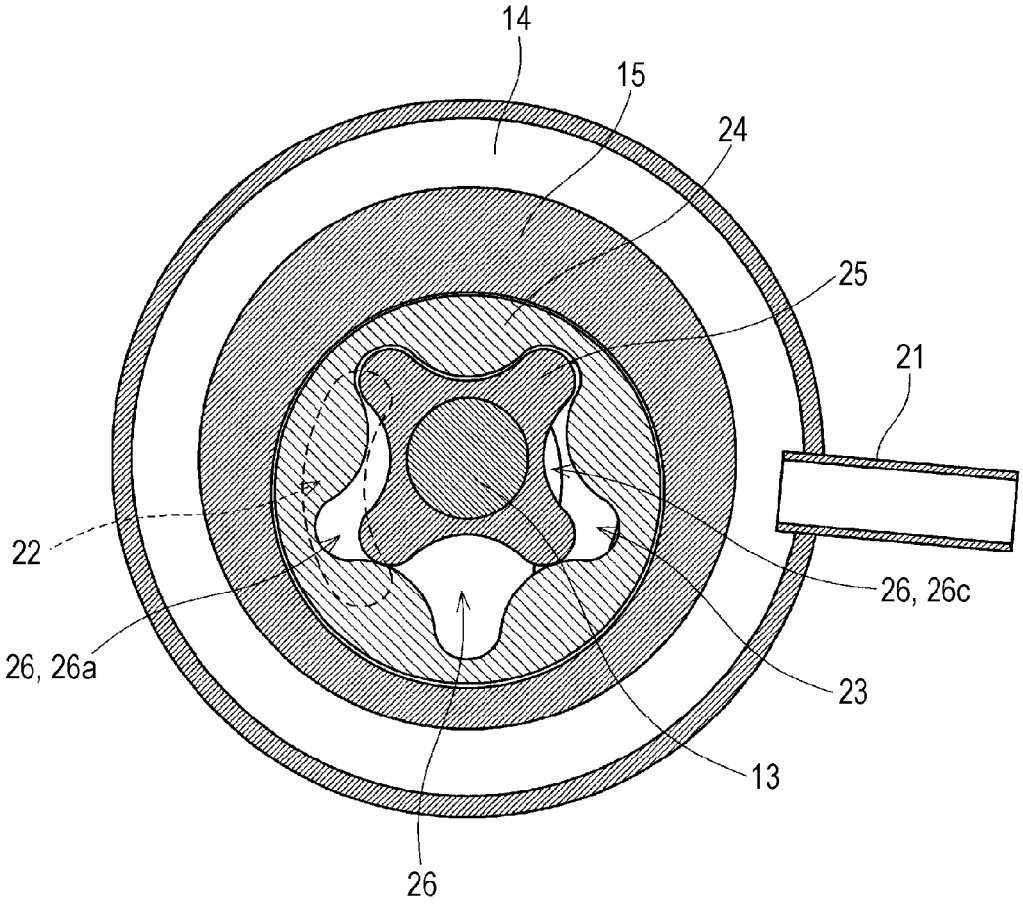
FIG. 2 is a cross-sectional view of the liquid pump taken along a line II-II in FIG. 1.

The pump mechanism 12 is an internal gear pump, for example. As illustrated in FIG. 2, an outer gear 24 and an inner gear 25 are disposed in the pump case 15. The shaft 13 penetrates the lower bearing member 16 at the center of the lower bearing member 16. The suction hole 22 is formed in the lower bearing member 16. The shaft 13 penetrates the upper bearing member 14 at the center of the upper bearing member 14. The discharge hole 23 is formed in the upper bearing member 14. The outer gear 24 is disposed outside the inner gear 25. The teeth of the outer gear 24 and the teeth of the inner gear 25 are engaged. The inner gear 25 is fitted over the shaft 13. The rotation axis of the inner gear 25 is the same as a rotation axis P of the shaft 13. The outer gear 24 is disposed so that the rotation axis of the outer gear 24 has an offset with respect to the rotation axis P of the shaft 13. The outer gear 24 is turned by the teeth of the inner gear 25 with rotation of the inner gear 25 by the shaft 13, and thereby rotates together with the inner gear 25.

The upper bearing member 14, the lower bearing member 16, the outer gear 24, and the inner gear 25 form a working chamber 26 in the pump mechanism 12. The outer gear 24 and the inner gear 25 rotate as the shaft 13 rotates, and thereby the pump mechanism 12 operates while repeating a suction process and a discharge process. In other words, rotation of the outer gear 24 and the inner gear 25 changes the function of the working chamber 26 from the function as a suction chamber 26*a* to the function as a discharge chamber 26*c*, or from the state as the discharge chamber 26*c* to the state as the suction chamber 26*a*. The suction chamber 26*a* is a part of the working chamber 26 when communicating with the suction space 19 via the suction hole 22. The discharge chamber 26*c* is a part of the working chamber 26 when communicating with the discharge space 18 via the discharge hole 23. In the suction process, the capacity of the suction chamber 26*a* increases as the shaft 13 rotates. When the suction hole 22 is closed, preventing the suction chamber 26*a* from communicating with the suction space 19, the suction process ends. When the shaft 13 further rotates, the working chamber 26 in which the suction process has ended comes to communicate with the discharge space 18 via the discharge hole 23, thus changing to the function as the discharge chamber 26*c*. The capacity of the discharge chamber 26*c* then decreases as the shaft 13 rotates. When the discharge hole 23 is closed, thereby preventing the discharge chamber 26*c* from communicating with the discharge space 18, the discharge process ends. In this way, as a result of the rotation of the shaft 13, the liquid is sucked in by the pump mechanism 12 via the suction hole 22 and is discharged from the pump mechanism 12 via the discharge hole 23.

The pump mechanism 12 is fixed to the casing 10 in such a way that the upper bearing member 14 is welded to the inner peripheral surface of the casing 10, for example. The inner space of the casing 10 is separated by the upper bearing member 14 into the discharge space 18 and the suction space 19. The inner peripheral surface of the casing 10 includes only, as space-forming parts, a part that forms the suction space 19 and a part that forms the discharge space 18. Having the suction space 19 and the discharge space 18 makes it possible to prevent the pulsation caused by suction of liquid or discharge of liquid in the pump mechanism 12 from being transmitted to the outside of the liquid pump 1*a*. Alternatively, the inner space of the casing 10 may be separated into the discharge space 18 and the suction space 19 by the pump case 15 or the lower bearing member 16.

The motor 11 is disposed in the casing 10. The motor 11 is positioned above the upper bearing member 14. Specifically, the motor 11 is disposed in the discharge space 18. The motor 11 is connected to the pump mechanism 12 via the shaft 13 to drive the pump mechanism 12. Specifically, the motor 11 includes a stator 11*a* and a rotor 11*b*, and the rotor 11*b* is connected to the shaft 13. The stator 11*a* is fixed to the inner peripheral surface of the casing 10. The liquid pump 1*a* includes a terminal 17 that supplies electric power to the motor 11. The terminal 17 is provided to an upper part of the casing 10. When electric power is supplied to the motor 11, the shaft 13 rotates together with the rotor 11*b*, thereby driving the pump mechanism 12 as described above.

The rotor 11*b* is connected to the shaft 13 while being in contact with the shaft 13. In this way, the rotation axis of the rotor 11*b* and the rotation axis P of the shaft 13 can be prevented from being misaligned with each other. This can reduce the sliding loss of the pump mechanism 12 with the upper bearing member 14 and the lower bearing member 16 and thereby reduce wear of the shaft 13, the upper bearing member 14, and the lower bearing member 16, consequently increasing the reliability of the liquid pump 1*a*. In addition, the efficiency of the motor 11 is improved.

The feed pipe 21 is attached to the casing 10 in such a way as to penetrate the side wall forming the barrel part of the casing 10. Liquid is brought into the casing 10 from outside the casing 10 through the feed pipe 21. The liquid flowing out from the feed pipe 21 flows through the suction space 19 toward the suction hole 22. The discharge pipe 20 is attached to the casing 10 in such a way as to penetrate the ceiling wall forming the upper surface of the casing 10. The flow path formed by the discharge pipe 20 communicates with the discharge space 18. The discharge pipe 20 is a pipe that discharges, from the liquid pump 1*a*, the liquid discharged from the pump mechanism 12 to the discharge space 18 via the discharge hole 23.

An end 21*e* of the feed pipe 21 on the side with the casing 10 is positioned at the height of the inlet 22*i* of the suction hole 22 or above the inlet 22*i* of the suction hole 22 when viewed vertically. With the above-described positional relationship between the end 21*e* of the feed pipe 21 on the side with the casing 10 and the inlet 22*i* of the suction hole 22, even when gas is brought into the casing 10 together with the liquid through the feed pipe 21, it is difficult for the gas to reach the inlet 22*i* of the suction hole 22. The suction space 19 includes a gas accumulation area 19*c*, which is positioned above a center 21*c* of the opening at the end 21*e* of the feed pipe 21 on the side with the casing 10 and which accumulates the gas brought into the casing 10 through the feed pipe 21 together with the liquid to separate the gas from the liquid. This allows, even when gas is brought together with liquid through the feed pipe 21, the gas to be accumulated in the gas accumulation area 19*c* and consequently to be separated from the liquid, thus making it easier for only the liquid to reach the suction hole 22. Since gas is prevented from flowing into the pump mechanism 12, damage to the components of the pump mechanism 12 can be prevented.

To increase the possibility that gas is accumulated and separated from liquid in the gas accumulation area 19*c*, it is desirable that the gas accumulation area 19*c* extend above the end 21*e* of the feed pipe 21 on the side with the casing 10, for example. Moreover, the end 21*e* of the feed pipe 21 on the side with the casing 10 is preferably provided in such a way as to protrude inward from the inner peripheral surface of the casing 10. The gas accumulation area 19*c* preferably includes a part positioned above the vertical center of the working chamber 26 of the pump mechanism 12. In such a case, the gas accumulation area 19*c* is provided even higher, making it difficult for the gas in the gas accumulation area 19*c* separated from the liquid to flow toward the suction hole 22.

The end 21*e* of the feed pipe 21 on the side with the casing 10, the dividing member 27, and the inlet 22*i* of the suction hole 22 are disposed in this order from above. The liquid pump 1*a* further includes predetermined members disposed on a line segment L connecting the center 21*c* of the opening at the end 21*e* and a center 22*c* of the inlet 22*i* of the suction hole 22. In this embodiment, the pump case 15, the lower bearing member 16, and the shaft 13 correspond to the predetermined members disposed on the line segment Las illustrated in FIG. 1. With this configuration, the suction space 19 is formed so as to avoid the predetermined members, which can consequently prevent the liquid flowing into the casing 10 through the feed pipe 21 from flowing into the suction hole 22 of the pump mechanism 12 via the shortest path corresponding to the straight line connecting the feed pipe 21 to the suction hole 22 of the pump mechanism 12.

Figure 3:
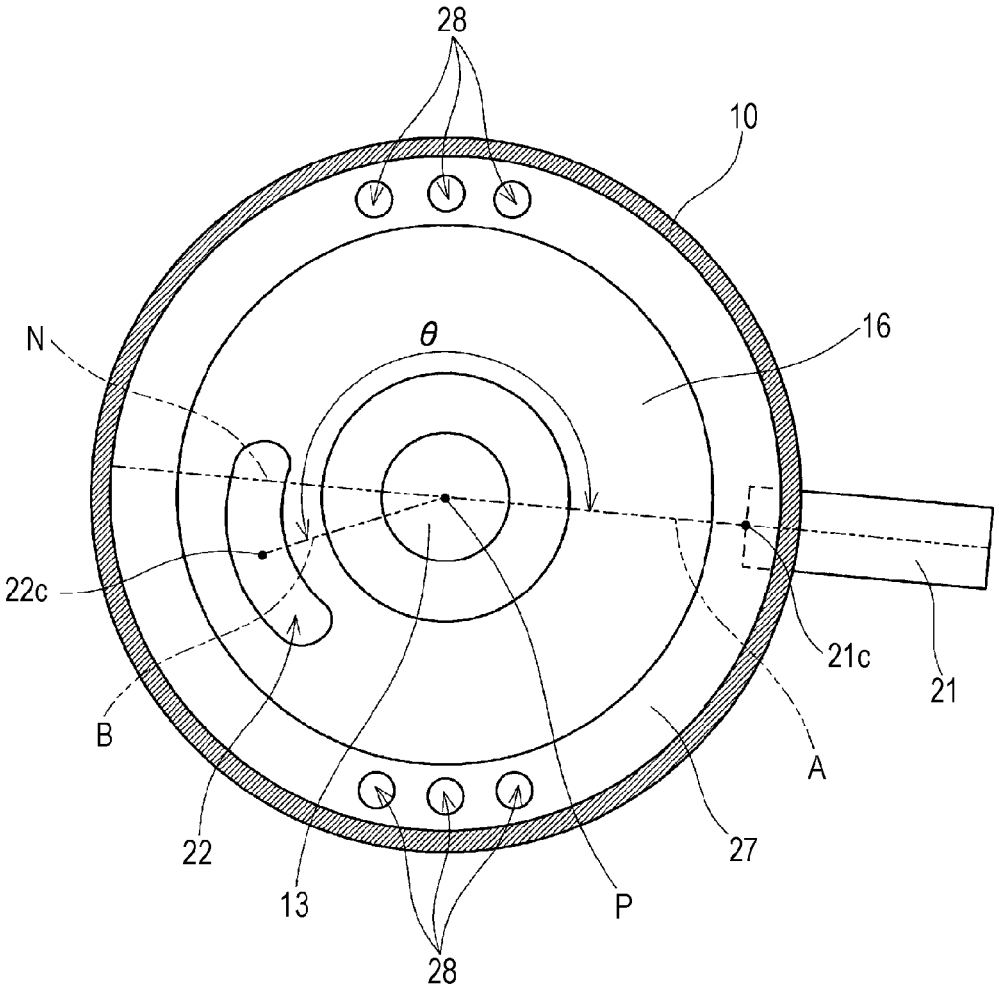
FIG. 3 is a cross-sectional view of the liquid pump taken along a line III-III in FIG. 1.

The dividing member 27 divides the suction space 19 into an upper space 19*a* and a lower space 19*b*. The upper space 19*a* is a space that is in contact with the end 21*e* of the feed pipe 21 on the side with the casing 10. The lower space 19*b* is a space that is in contact with the inlet 22*i* of the suction hole 22. As illustrated in FIG. 3, communication paths 28 are formed in the dividing member 27, and the upper space 19*a* and the lower space 19*b* communicate with each other via the communication paths 28. The number of the communication paths 28 is not particularly limited. The number of the communication paths 28 formed in the dividing member 27 may be one or more.

The dividing member 27 is disposed closer to the outer periphery than the lower bearing member 16 is. The dividing member 27 extends in the direction orthogonal to the rotation axis P of the shaft 13 (the radial direction of the shaft 13), and is formed so as to encircle the lower bearing member 16. The dividing member 27 is disposed so that the outer peripheral surface of the dividing member 27 is positioned farther from the rotation axis P of the shaft 13 than the outer peripheral surface of the pump case 15. For example, the dividing member 27 is disposed so that the outer peripheral surface of the dividing member 27 is in contact with the inner peripheral surface of the casing 10. The dividing member 27 has an annular shape in plan view.

As illustrated in FIG. 1 and FIG. 3, the feed pipe 21 is disposed so that a straight line N extending along the central axis of the feed pipe 21 to inside the casing 10 and a straight line M passing the center 22*c* of the inlet 22*i* of the suction hole 22 and being orthogonal to the inlet 22*i* of the suction hole 22 are included in different planes. In other words, the feed pipe 21 is disposed so that the straight line N and the straight line M do not intersect. Assume that a first line segment A connecting the center 21*c* of the opening at the end 21*e* of the feed pipe 21 on the side with the casing 10 and the rotation axis P of the shaft 13 and a second line segment B connecting the center 22*c* of the inlet 22*i* of the suction hole 22 and the rotation axis P of the shaft 13 are projected on a plane orthogonal to the rotation axis P of the shaft 13. In this case, the feed pipe 21 is disposed so that an angle θ between the line segment A and the line segment B is in the range of 90° to 270°. In this embodiment, the angle θ between the line segment A and the line segment B is 200°. Disposing the feed pipe 21 as described above increases the length of the path along which the liquid brought into the casing 10 through the feed pipe 21 flows to reach the suction hole 22 of the pump mechanism 12, consequently making it possible to increase the period for separating gas from liquid in the suction space 19.

The suction space 19 includes a reservoir area 19*d* for holding the liquid. To hold the liquid, the suction space 19 is formed to have a sufficient depth below the suction hole 22. The suction space 19 has, as the reservoir area 19*d*, a space having a capacity that is, for example, 20 to 300 times larger than the capacity of the working chamber 26 of the pump mechanism 12, although also depending on the capacity of the piping of the entire Rankine cycle device. With this configuration, the liquid can be held in the reservoir area 19*d*, and hence the liquid pump 1*a* can be used for a Rankine cycle device, for example.

The liquid flows into the upper space 19*a* of the suction space 19 through the feed pipe 21. The liquid flowing into the upper space 19*a* flows in the circumferential direction of the casing 10, flows along the communication paths 28 formed in the dividing member 27, and then flows into the lower space 19*b*. When gas is brought together with the liquid through the feed pipe 21, the gas is accumulated in the gas accumulation area 19*c* in an upper part of the upper space 19*a* while the liquid is accumulated in a lower part of the upper space 19*a*. Thus, only the liquid flows along the communication paths 28.

The liquid flowing into the lower space 19*b* is sucked into the suction chamber 26*a* from the inlet 22*i* of the suction hole 22 via the suction hole 22. As the capacity of the suction chamber 26*a* increases with the rotation of the shaft 13 in the suction process, the suction chamber 26*a* is filled with the liquid. When the shaft 13 further rotates, thereby changing to the discharge process, the liquid is discharged via the discharge hole 23 while the capacity of the discharge chamber 26*c* decreases. The liquid discharged into the discharge space 18 flows upward in the discharge space 18 through a gap between the stator 11*a* and the inner peripheral surface of the casing 10 and the gap between the stator 11*a* and the rotor 11*b*, and is then discharged from the casing 10 through the discharge pipe 20.

Rankine Cycle Device

Figure 4:
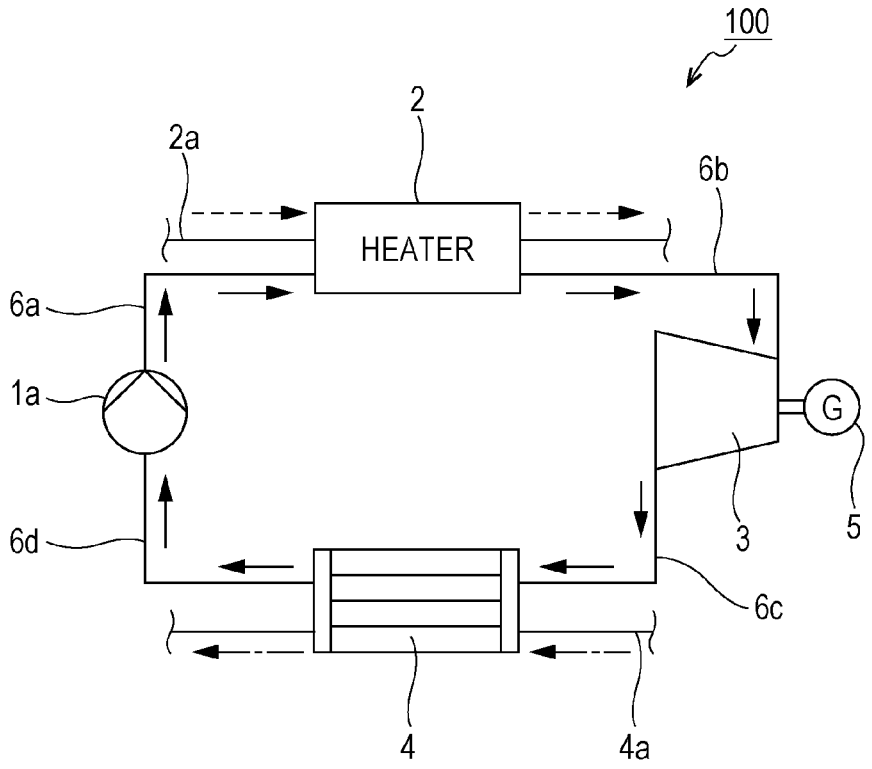
FIG. 4 is a diagram of a configuration of a Rankine cycle device according to an exemplary embodiment of the present disclosure.

Next, a Rankine cycle device 100 including the liquid pump 1*a* will be described. As illustrated in FIG. 4, the Rankine cycle device 100 includes a heater 2, an expander 3, a radiator 4, and the liquid pump la. The Rankine cycle device 100 includes a flow path 6*a*, a flow path 6*b*, a flow path 6*c*, and a flow path 6*d*, which connect the heater 2, the expander 3, the radiator 4, and the liquid pump 1*a* annularly. The flow path 6*a* connects the outlet of the liquid pump 1*a* and the inlet of the heater 2. The discharge pipe 20 forms at least part of the flow path 6*a*. The flow path 6*b* connects the outlet of the heater 2 and the inlet of the expander 3. The flow path 6*c* connects the outlet of the expander 3 and the inlet of the radiator 4. The flow path 6*d* connects the outlet of the radiator 4 and the inlet of the liquid pump 1*a*. The feed pipe 21 forms at least part of the flow path 6*d*.

For example, organic working fluid may be used preferably as working fluid in the Rankine cycle device 100, although the working fluid is not particularly limited.

Examples of the organic working fluid are organic compounds such as halogenated hydrocarbons, hydrocarbons, and alcohol. Halogenated hydrocarbons are, for example, R-123, R365mfc, and R-245fa. Hydrocarbons are, for example, alkanes such as propane, butane, pentane, and isopentane. Alcohol is, for example, ethanol. These organic working fluids may be used individually, or two or more kinds of the organic working fluids may be mixed. Alternatively, inorganic working fluids such as water, carbon dioxide, and ammonia may be used as the working fluid.

The heater 2 heats the working fluid in the Rankine cycle. The heater 2 absorbs, for example, the thermal energy from a heat transfer medium such as hot water obtained by using geothermal energy, or combustion gas or exhaust from a boiler or a combustion furnace, and heats the working fluid with the absorbed thermal energy and thereby evaporates the working fluid. A flow path 2*a* for the heat transfer medium is connected to the heater 2. When the heat transfer medium is a liquid such as hot water, a plate heat exchanger or a double-pipe heat exchanger is preferably used as the heater 2. When the heat transfer medium is a gas such as combustion gas or exhaust, a fin and tube heat exchanger is preferably used as the heater 2. In FIG. 4, solid arrows indicate the direction in which the working fluid flows, and dashed arrows indicate the direction in which the heat transfer medium flows.

The expander 3 is a fluid machine that expands the working fluid heated by the heater 2. The Rankine cycle device 100 further includes an electric generator 5. The electric generator 5 is connected to the expander 3. The expander 3 obtains rotational power as a result of expansion of the working fluid in the expander 3. The rotational power is converted to electricity by the electric generator 5. The expander 3 is a positive-displacement or velocity expander, for example. Examples of the types of positive-displacement expanders are rotary type, screw type, reciprocating type, and scroll type. Examples of the types of velocity expander are centrifugal type and axial-flow type. The expander 3 is typically a positive-displacement expander.

The radiator 4 dissipates heat of the working fluid expanded by the expander 3. Specifically, in the radiator 4, the working fluid is cooled by thermal exchange of the working fluid with a cooling medium, which heats the cooling medium. A flow path 4*a* for the cooling medium is connected to the radiator 4. In FIG. 4, dashed-dotted arrows indicate the direction in which the cooling medium flows. A known heat exchanger such as a plate heat exchanger, a double-pipe heat exchanger, or a fin and tube heat exchanger can be used as the radiator 4. The type of the radiator 4 is appropriately selected according to the type of the cooling medium. When the cooling medium is liquid such as water, a plate heat exchanger or a double-pipe heat exchanger is preferably used. When the cooling medium is gas such as air, a fin and tube heat exchanger is preferably used.

The working fluid flowing out from the radiator 4 is in a liquid state. Hence, the liquid working fluid flowing out from the radiator 4 is brought into the casing 10 through the feed pipe 21. The liquid pump 1*a* applies pressure to the working fluid, and the pressurized working fluid is fed to the heater 2 through the flow path 6*a*. To increase the efficiency of the Rankine cycle, the working fluid flowing out from the radiator 4 and then into the liquid pump 1*a* is desirably supercooled liquid having a smallest-possible degree of supercooling or is saturated liquid. However, the working fluid in such a state easily enters the gas-liquid two-phase state as a result of a slight reduction in pressure or slight heating. This may cause gas to be brought into the casing 10 together with a liquid through the feed pipe 21. In such a case, the above-described configuration of the liquid pump 1*a* can prevent the gas from flowing into the pump mechanism 12, consequently preventing damage to the components of the pump mechanism 12. The same effects can also be obtained when cooling of the working fluid in the radiator 4 is insufficient due to the operation state of the Rankine cycle device 100 and the working fluid in the gas-liquid two-phase state is fed to the liquid pump 1*a* through the feed pipe 21, for example.

Since the working fluid collects, in the discharge space 18, heat generated in the motor 11, the liquid pump 1*a* is highly efficient. Hence, the Rankine cycle device 100 is also highly efficient.

The pressure condition and the temperature condition of the working fluid in the Rankine cycle change depending on the operation condition of the Rankine cycle device. The operation condition includes, for example, the temperature of the heat transfer medium flowing into the heater 2, the amount of heat in the thermal exchange between the working fluid and the heat transfer medium in the heater 2, the temperature of the cooling medium flowing into the radiator 4, the amount of heat in the thermal exchange between the working fluid and the cooling medium in the heater 2, and the rotational speed of the expander 3. The optimal amount of working fluid in the Rankine cycle device 100 changes in accordance with the operation condition of the Rankine cycle device 100. The liquid pump 1*a*, which is capable of holding a certain amount of liquid working fluid in the reservoir area 19*d*, can address changes in the optimal amount of working fluid caused by changes in the operation condition. Hence, operation of the Rankine cycle device 100 with high cycle efficiency is possible.

First Modified Embodiment

Modifications can be made to the liquid pump 1*a* in various respects. The liquid pump 1*a* may be modified as a liquid pump 1*b* according to a first modified embodiment illustrated in FIG. 5. The liquid pump 1*b* has the same configuration as that of the liquid pump 1*a* unless otherwise stated. Components of the liquid pump 1*b* that are the same as or correspond to components of the liquid pump 1*a* are denoted by the same numerals as those used for the liquid pump 1*a*, and detailed description may be omitted. The description of the liquid pump 1*a* also applies to the liquid pump 1*b* as long as no technical conflicts are involved. The same applies to a second modified embodiment.

Figure 5:
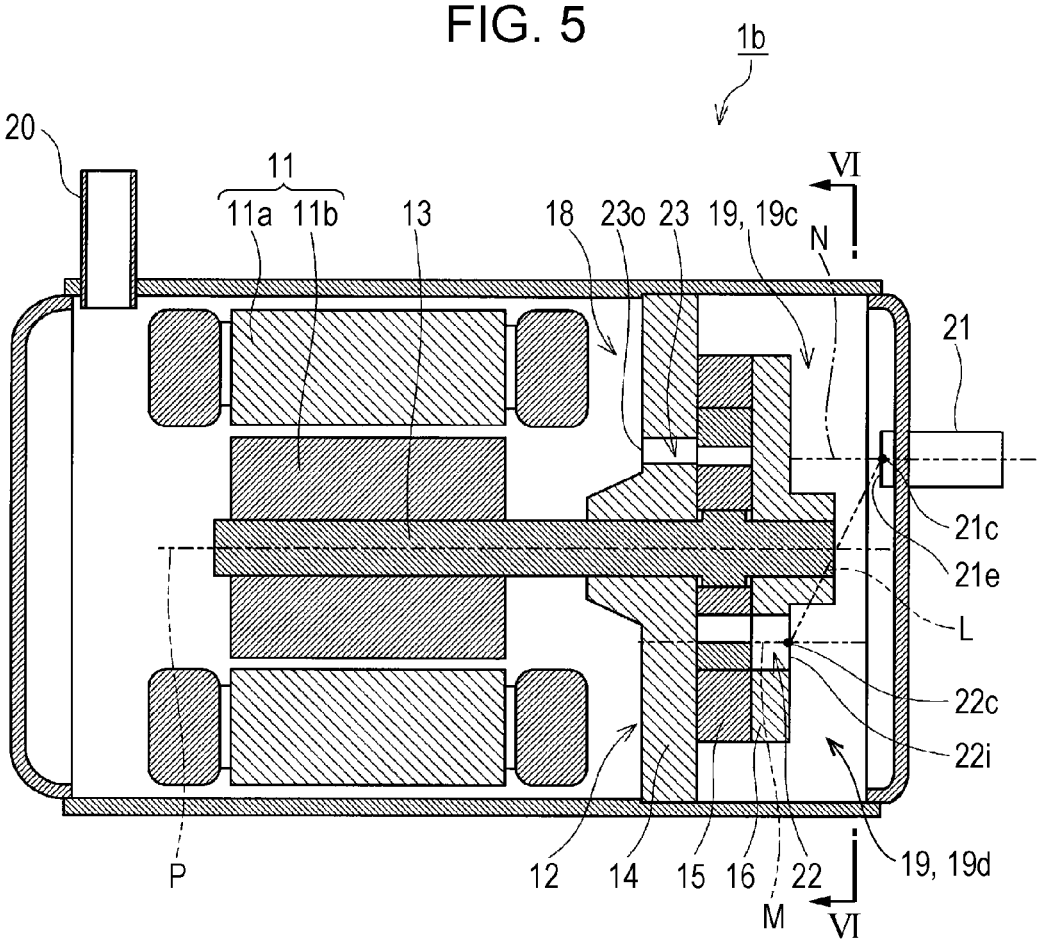
FIG. 5 is a longitudinal sectional view of a liquid pump according to a first modified embodiment.

As illustrated in FIG. 5, the shaft 13 extends horizontally in the liquid pump 1*b*. With this modification, the casing 10, the motor 11, and the pump mechanism 12 in the liquid pump 1*b* are disposed as the liquid pump 1*a* is rotated 90° so that the suction hole 22 is positioned below the rotation axis P of the shaft 13. In addition, the dividing member 27 is omitted.

The feed pipe 21 is attached in such a way as to penetrate the side wall of the casing 10 at a position above the rotation axis P of the shaft 13. Accordingly, the gas accumulation area 19*c* of the suction space 19 is positioned above the rotation axis P of the shaft 13. This allows the gas accumulation area 19*c* to be positioned further above, thereby making it easier for gas to be accumulated in the gas accumulation area 19*c* and consequently making it difficult for the gas separated from liquid to flow toward the suction hole 22.

As illustrated in FIG. 5, the shaft 13 and the lower bearing member 16 correspond to the predetermined members disposed on the line segment L connecting the center 21*c* of the opening at the end 21*e* of the feed pipe 21 on the side with the casing 10 and the center 22*c* of the inlet 22*i* of the suction hole 22. Moreover, the feed pipe 21 is disposed so that the straight line N obtained by extending along the central axis of the feed pipe 21 to inside the casing 10 and the straight line M passing the center 22*c* of the inlet 22*i* of the suction hole 22 and being orthogonal to the inlet 22*i* of the suction hole 22 are included in different planes.

Figure 6:
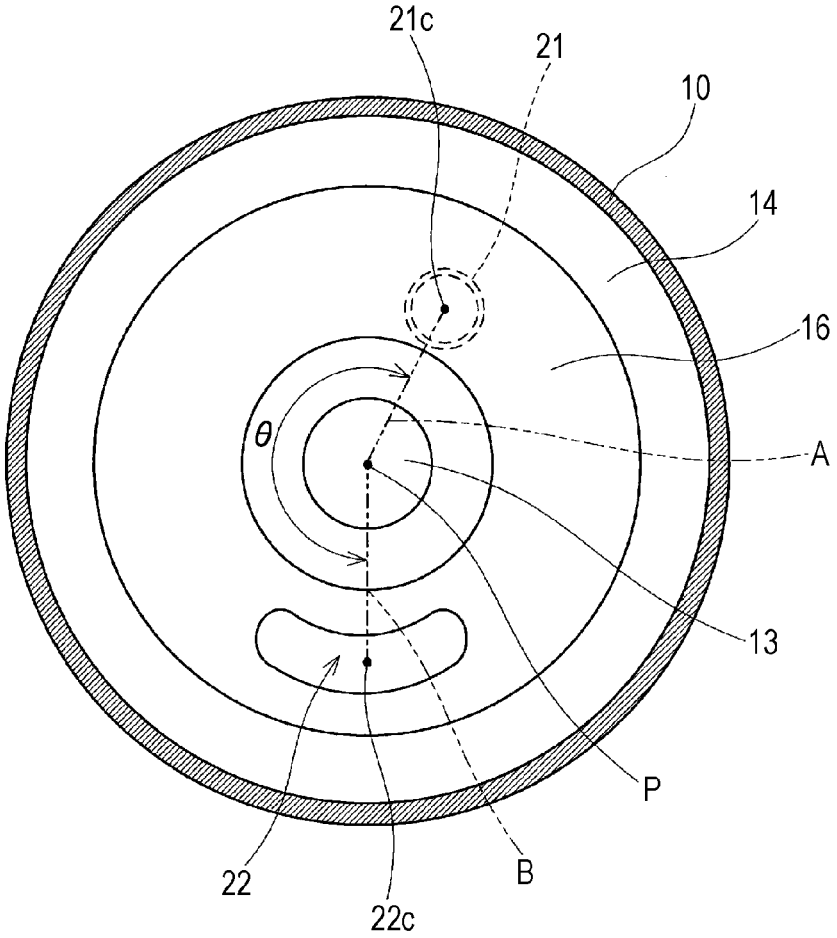
FIG. 6 is a cross-sectional view of the liquid pump taken along a line VI-VI in FIG. 5.

Assume that the line segment A, connecting the center 21*c* of the opening at the end 21*e* and the rotation axis P of the shaft 13, and the line segment B, connecting the center 22*c* of the inlet 22*i* of the suction hole 22 and the rotation axis P of the shaft 13, are projected on a plane orthogonal to the rotation axis P of the shaft 13. In this case, as illustrated in FIG. 6, the feed pipe 21 is disposed so that the angle θ between the line segment A and the line segment B is in the range of 90° to 270°.

Disposing the feed pipe 21 as described above increases the length of the path along which the liquid brought into the casing 10 through the feed pipe 21 flows to reach the suction hole 22 of the pump mechanism 12, consequently making it possible to increase the period for separating gas from the liquid in the suction space 19.

Second Modified Embodiment

Figure 7:
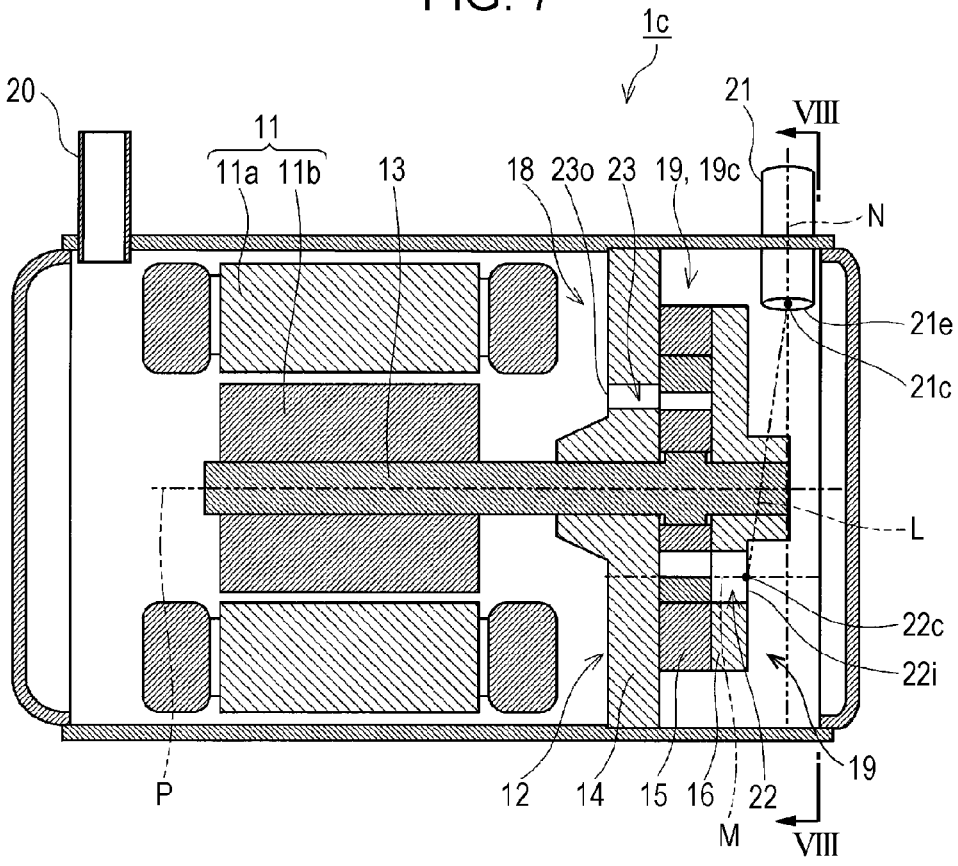
FIG. 7 is a longitudinal sectional view of a liquid pump according to a second modified embodiment.

The liquid pump 1*a* may be modified as a liquid pump 1*c* according to the second modified embodiment, as illustrated in FIG. 7. The liquid pump 1*c* has the same configuration as that of the liquid pump 1*b* except for the disposition of the feed pipe 21. The feed pipe 21 is attached to the casing 10 in such a way as to penetrate a wall of the casing 10, the wall forming the inner peripheral surface that extends in the peripheral direction of the rotation axis P of the shaft 13. The feed pipe 21 is disposed so that the end 21*e* of the feed pipe 21 on the side with the casing 10 is positioned closer than the inner peripheral surface of the casing 10 to the center of the casing 10 and is positioned above the rotation axis P of the shaft 13. Accordingly, the gas accumulation area 19*c* of the suction space 19 is provided above the rotation axis P of the shaft 13. This allows the gas accumulation area 19*c* to be provided further above, thereby making it easier for gas to be accumulated in the gas accumulation area 19*c* and consequently making it difficult for the gas separated from liquid to flow toward the suction hole 22.

As illustrated in FIG. 7, the shaft 13 and the lower bearing member 16 correspond to the predetermined members disposed on the line segment L connecting the center 21*c* of the opening at the end 21*e* of the feed pipe 21 on the side with the casing 10 and the center 22*c* of the inlet 22*i* of the suction hole 22. Moreover, the feed pipe 21 is disposed so that the straight line N obtained by extending along the central axis of the feed pipe 21 to inside the casing 10 and the straight line M passing the center 22*c* of the inlet 22*i* of the suction hole 22 and being orthogonal to the inlet 22*i* of the suction hole 22 are included in different planes.

Figure 8:
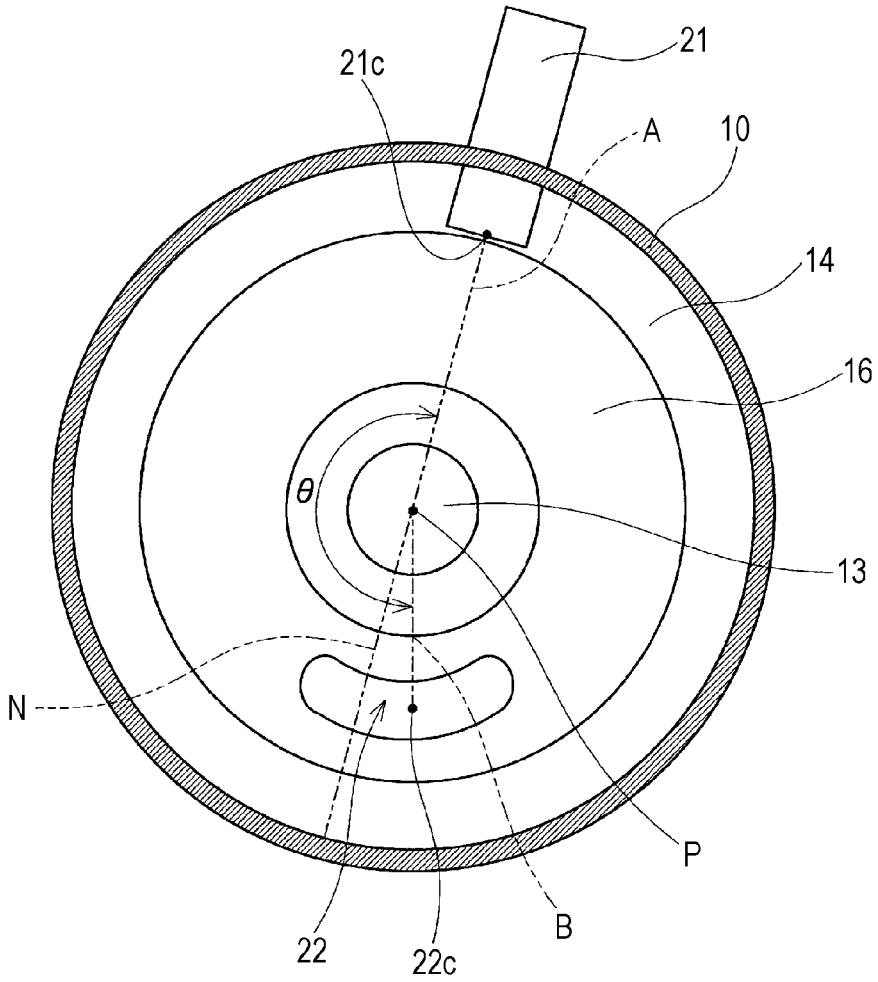
FIG. 8 is a cross-sectional view of the liquid pump taken along a line VIII-VIII in FIG. 7.
Figure 9:
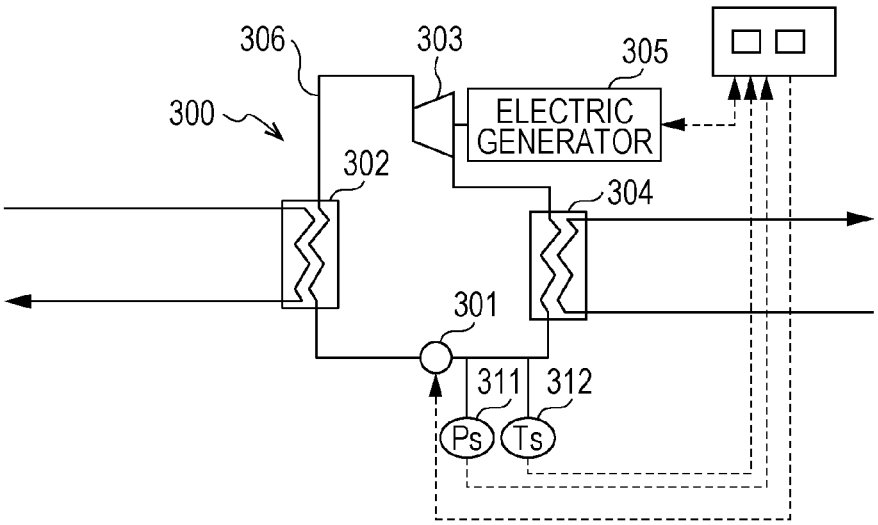
FIG. 9 PRIOR ART
FIG. 9 is a diagram of a configuration of a conventional electric generating device.
Figure 10:
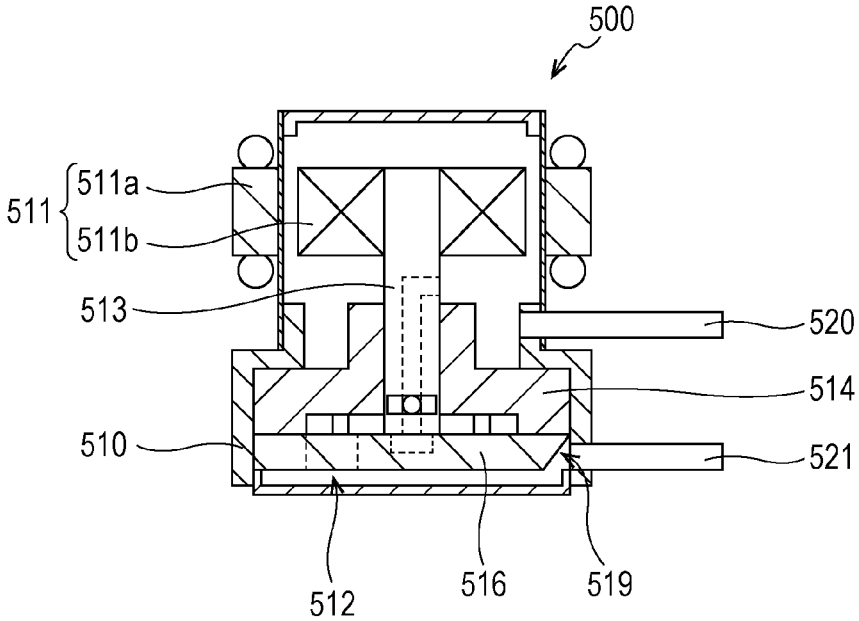
FIG. 10 PRIOR ART
FIG. 10 is a longitudinal sectional view of a conventional refrigerant pump.

Assume that the line segment A, connecting the center 21*c* of the opening at the end 21*e* of the feed pipe 21 on the side with the casing 10 and the rotation axis P of the shaft 13, and the line segment B, connecting the center 22*c* of the inlet 22*i* of the suction hole 22 and the rotation axis P of the shaft 13, are projected on a plane orthogonal to the rotation axis P of the shaft 13. In this case, as illustrated in FIG. 8, the feed pipe 21 is disposed so that the angle θ between the line segment A and the line segment B is in the range of 90° to 270°.

Disposing the feed pipe 21 as described above increases the length of the path along which the liquid brought into the casing 10 through the feed pipe 21 flows to reach the suction hole 22 of the pump mechanism 12, consequently making it possible to increase the period for separating gas from the liquid in the suction space 19.

Other Modified Embodiments

The liquid pump 1*a* may be modified to have a configuration as a pump other than an internal gear pump. The liquid pump 1*a* may be configured as a positive-displacement pump such as a gear pump of a different type, a piston pump, a vane pump, or a rotary pump, or a velocity pump such as a centrifugal pump, a mixed-flow pump, or an axial-flow pump.

The dividing member 27 may be formed of a punching plate or a mesh member. Alternatively, tiny protrusions having antifoaming effects may be formed on the dividing member 27. The dividing member 27 may be omitted.

What is claimed is:

1. A liquid pump comprising:

a casing;

a feed pipe that brings liquid from outside the casing to inside the casing;

a pump mechanism that is provided inside the casing, and that includes a suction hole through which the liquid is sucked in and a discharge hole through which the liquid sucked in via the suction hole is discharged;

a suction space that is extended from an opening of the feed pipe to an inlet of the suction hole in the casing, and that connects a flow path formed by the feed pipe to the suction hole;

a discharge space that is positioned on a side with an outlet of the discharge hole in the casing and that connects to the discharge hole; and a member that is provided on a line segment connecting the center of the opening at the end of the feed pipe on the side with the casing and a center of the inlet of the suction hole, wherein the suction space includes a gas accumulation area that is positioned above a center of the opening of the feed pipe on a side with the casing, in a cross section view of the liquid pump, and that accumulates gas brought into the casing through the feed pipe together with the liquid to separate the gas from the liquid, the suction space includes a reservoir area that holds the liquid, and the end of the feed pipe on the side with the casing is positioned at a height of the inlet of the suction hole or above the inlet of the suction hole, in the cross section view of the liquid pump.

2. The liquid pump according to claim 1, wherein an inner peripheral surface of the casing includes, as space-forming parts, only a part that forms the suction space and a part that forms the discharge space.

3. The liquid pump according to claim 1, further comprising a shaft, wherein the pump mechanism sucks in the liquid via the suction hole and discharges the liquid via the discharge hole by rotation of the shaft.

4. The liquid pump according to claim 1, further comprising a dividing member that divides the suction space into an upper space that is in contact with the end of the feed pipe on the side with the casing and a lower space that is in contact with the inlet of the suction hole.

5. The liquid pump according to claim 1, wherein a straight line that extends along a central axis of the feed pipe to inside the casing and a straight line that passes a center of the inlet of the suction hole and is orthogonal to the inlet of the suction hole are included in different planes.

6. The liquid pump according to claim 3, wherein, when a first line segment and a second line segment are projected on a plane orthogonal to the rotation axis of the shaft, an angle between the first line segment and the second line segment is in a range of 90° to 270°, the first line segment connects the center of the opening at the end of the feed pipe on the side with the casing and the rotation axis of the shaft, the second line segment connects a center of the inlet of the suction hole and the rotation axis of the shaft.

7. The liquid pump according to claim 3, further comprising an electric motor that is provided inside the casing, is connected to the pump mechanism via the shaft, and drives the pump mechanism.

8. The liquid pump according to claim 7, wherein the electric motor is provided in the discharge space.

9. A Rankine cycle device comprising:

a heater that heats working fluid;

an expander that expands the working fluid heated by the heater;

a radiator that dissipates heat of the working fluid expanded by the expander; and a liquid pump according to claim 1, wherein the working fluid in a liquid state flowing out from the radiator is brought, as the liquid, to inside the casing via the feed pipe.

10. The liquid pump according to claim 1, further comprising:

a discharge pipe that discharges the liquid discharged from the pump mechanism to the discharge space via the discharge hole; and a flow path formed by the discharge pipe communicating with the discharge space.

11. The liquid pump according to claim 2, further comprising:

a discharge pipe that discharges the liquid discharged from the pump mechanism to the discharge space via the discharge hole; and a flow path formed by the discharge pipe communicating with the discharge space.

12. The liquid pump according to claim 8, further comprising:

a discharge pipe that discharges the liquid discharged from the pump mechanism to the discharge space via the discharge hole; and a flow path formed by the discharge pipe communicating with the discharge space.

13. The liquid pump according to claim 1, wherein the member includes at least two of a pump case, a lower bearing member, and a shaft.

14. The liquid pump according to claim 1, wherein the pump mechanism includes a pump case between an upper bearing member and a lower bearing member, the upper bearing member includes the discharge hole, and the lower bearing member includes the suction hole.

15. The liquid pump according to claim 4, wherein the dividing member includes a plurality of communication paths.

* * * * *